US010991301B2

(12) United States Patent
Lee et al.

(10) Patent No.: US 10,991,301 B2
(45) Date of Patent: Apr. 27, 2021

(54) ORGANIC LIGHT-EMITTING DISPLAY DEVICE

(71) Applicant: LG DISPLAY CO., LTD., Seoul (KR)

(72) Inventors: JongHyuck Lee, Gumi-si (KR); SangBin Lee, Goyang-si (KR); JinHoo Kang, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/215,107

(22) Filed: Dec. 10, 2018

(65) Prior Publication Data

US 2019/0180683 A1 Jun. 13, 2019

(30) Foreign Application Priority Data

Dec. 11, 2017 (KR) ..... 10-2017-0169623

(51) Int. Cl.

| | |
|---|---|
| ***G09G 3/3233*** | (2016.01) |
| ***G09G 3/00*** | (2006.01) |
| ***G09G 3/3208*** | (2016.01) |
| ***G09G 3/3275*** | (2016.01) |

(52) U.S. Cl.

CPC ..... *G09G 3/3233* (2013.01); *G09G 3/006* (2013.01); *G09G 3/3208* (2013.01); *G09G 3/3275* (2013.01); *G09G 2300/0426* (2013.01); *G09G 2330/12* (2013.01)

(58) Field of Classification Search

CPC .... G09G 3/3233; G09G 3/3208; G09G 3/006; G09G 3/3275; G09G 2330/12; G09G 2300/0426

See application file for complete search history.

(56) References Cited

U.S. PATENT DOCUMENTS

| | | | | |
|---|---|---|---|---|
| 2011/0080173 | A1 | 4/2011 | Kim et al. | |
| 2011/0175800 | A1* | 7/2011 | Mizumaki | H05K 1/0268 345/87 |
| 2014/0240521 | A1* | 8/2014 | Kwak | H04N 17/004 348/189 |
| 2016/0043010 | A1* | 2/2016 | Kwak | H01L 27/124 257/48 |
| 2016/0225312 | A1* | 8/2016 | Byun | G09G 3/006 |
| 2016/0232826 | A1* | 8/2016 | Cho | H01L 27/3276 |
| 2016/0260367 | A1* | 9/2016 | Kwak | G09G 3/006 |
| 2016/0372017 | A1* | 12/2016 | Byun | G09G 3/20 |
| 2017/0069239 | A1* | 3/2017 | Kwon | H01L 27/124 |

* cited by examiner

*Primary Examiner* — Jonathan A Boyd

(74) *Attorney, Agent, or Firm* — Birch, Stewart, Kolasch & Birch, LLP

(57) ABSTRACT

An organic light-emitting display device includes a substrate including an active area in which a plurality of pixels are defined, and a non-active area surrounding the active area and having a pad area in which a plurality of pads are disposed on one side of the active area; a plurality of power supply lines disposed in the active area; a plurality of test transistors disposed in the non-active area on another side of the active area; and a plurality of power supply transistors connected to the plurality of power supply lines. Each of the power supply transistors is disposed next to the respective test transistors. A uniform supply voltage can thus be applied across a plurality of pixels without any additional process such that uniformity of luminance can be improved.

12 Claims, 5 Drawing Sheets

ORGANIC LIGHT-EMITTING DISPLAY DEVICE

CROSS-REFERENCE TO RELATED APPLICATIONS

This application claims the priority of Korean Patent Application No. 10-2017-0169623 filed on Dec. 11, 2017, in the Korean Intellectual Property Office, the disclosure of which is incorporated herein by reference into the present application.

BACKGROUND

Technical Field

The present disclosure relates to an organic light-emitting display device and more particularly, to an organic light-emitting display device with uniform luminance by achieving a uniform high-level voltage.

Description of the Related Art

Flat panel display devices such as liquid-crystal display devices, organic light-emitting display devices, emissive displays, etc. have a thin thickness and low power consumption, and thus are attracting attention.

Among a variety of display devices, organic light-emitting display devices have advantages in that they emit light on their own, have a wide viewing angle, good contrast ratio and fast response speed.

However, if a defect occurs during the process of manufacturing the organic light-emitting display devices, some pixels may not be normally turned on or operate abnormally. In order to detect a lighting failure caused in the process of manufacturing the organic light-emitting display device, a separate lighting test, such as a so-called AP test, is carried out. Such a lighting test is carried out by using a lighting test pad or a lighting test transistor formed on the substrate of the organic light-emitting display device.

Typically, in an organic light-emitting display device, a high-level voltage is applied to a plurality of pixels via power supply lines extended from a supply voltage line disposed in a non-active area to an active area. As the resolution of the organic light-emitting display devices becomes higher and higher due to the increased consumer demand for high resolution contents, the space allocated to the power supply lines needs to decrease to accommodate a greater number of pixels, and thus the decreased width of the power supply lines causes problems.

In addition, as the screen size of the organic light-emitting display devices is increased due to the consumer demand for larger screens, the length of the power supply lines is increased. As a result, the resistance on the power supply lines increases and a voltage drop occurs in the high-level voltage supplied to the pixels, which is a problem.

SUMMARY

The present inventors have recognized that a voltage drop in a high-level voltage applied through the power supply lines causes the luminance of the display device can become different from location to location, resulting in a non-uniform brightness across the display screen.

Based upon such specified problem recognition by the present inventors, the present inventors have conducted a lighting test on a display substrate having a plurality of lighting test transistors placed in an area opposite to the area where the pads are disposed. If the lighting test shows that an organic light-emitting display device is not defective, the area where the lighting test transistors are disposed and the area where the various lines connecting the pads to the lighting test transistors are no longer necessary. Therefore, the present inventors have conducted studies to utilize the substrate areas used for the lighting test for other purposes.

In view of the above, an aspect of the present disclosure is to provide an organic light-emitting display device having a novel structure that can mitigate a voltage drop in a high-level voltage and utilize the substrate space more efficiently for the areas where the lines and transistors used for the lighting test.

Another aspect of the present disclosure is to provide an organic light-emitting display device that can mitigate a voltage drop in a high-level voltage by applying the high-level voltage to power supply lines from two sides of the active area and can suppress non-uniform luminance across the pixels.

Yet another aspect of the present disclosure is to provide an organic light-emitting display device that can utilize the substrate space more efficiently by adding so-called power supply transistors, which are used for applying a high-level voltage, into the area where a plurality of test transistors used for the lighting test are disposed.

It should be noted that aspects of the present disclosure are not limited to those described above, and other aspects of the present disclosure will be understood to those skilled in the art from the following description.

According to an aspect of the present disclosure, there is provided an organic light-emitting display device including a substrate having an active area in which a plurality of pixels are defined, and a non-active area surrounding the active area and having a pad area in which a plurality of pads are disposed on one side of the active area; a plurality of power supply lines disposed in the active area; a plurality of test transistors disposed in the non-active area on another side of the active area; and a plurality of power supply transistors connected to the plurality of power supply lines and disposed next to the respective test transistors. Thus, a voltage drop in a high-level voltage can be suppressed while improving substrate space utilization when compared to the related art.

According to another aspect of the present disclosure, there is provided an organic light-emitting display device including a substrate having an active area in which a plurality of pixels are defined, and a non-active area surrounding the active area and having a pad area is disposed on one side of the active area; a plurality of power supply lines disposed in the active area; a plurality of test transistors disposed in the non-active area on two sides of the active area; and a plurality of power supply transistors each disposed between two of the test transistors. The power supply transistors apply a high-level voltage to the power supply lines to reduce a voltage drop in the power supply lines. Thus, the uniformity of luminance across pixels can be improved without increasing a size of the non-active area when compared to the related art.

The details of one or more embodiments of the subject matter described in this specification are set forth in the accompanying drawings and the description below.

According to an exemplary embodiment of the present disclosure, by adding power supply transistors to the area where test transistors for the lighting test are disposed, it is possible to utilize the substrate space more efficiently and to suppress a voltage drop in a high-level voltage.

Further, according to an exemplary embodiment of the present disclosure, by using the lines used for the lighting test for applying a high-level voltage, it is possible to improve uniformity in luminance across the pixels without increasing the substrate area of the non-active area.

Further, according to an exemplary embodiment of the present disclosure, the power supply transistors can be formed together with the transistors for the lighting test without any additional mask process during manufacturing.

It should be noted that effects of the present disclosure are not limited to those described above and other effects of the present disclosure will be understood by those skilled in the art from the following descriptions.

BRIEF DESCRIPTION OF THE DRAWINGS

The above and other aspects, features and other characteristics of the present disclosure will be more clearly understood from the following detailed description taken in conjunction with the accompanying drawings, in which.

DETAILED DESCRIPTION OF THE EMBODIMENTS

Figure 1:
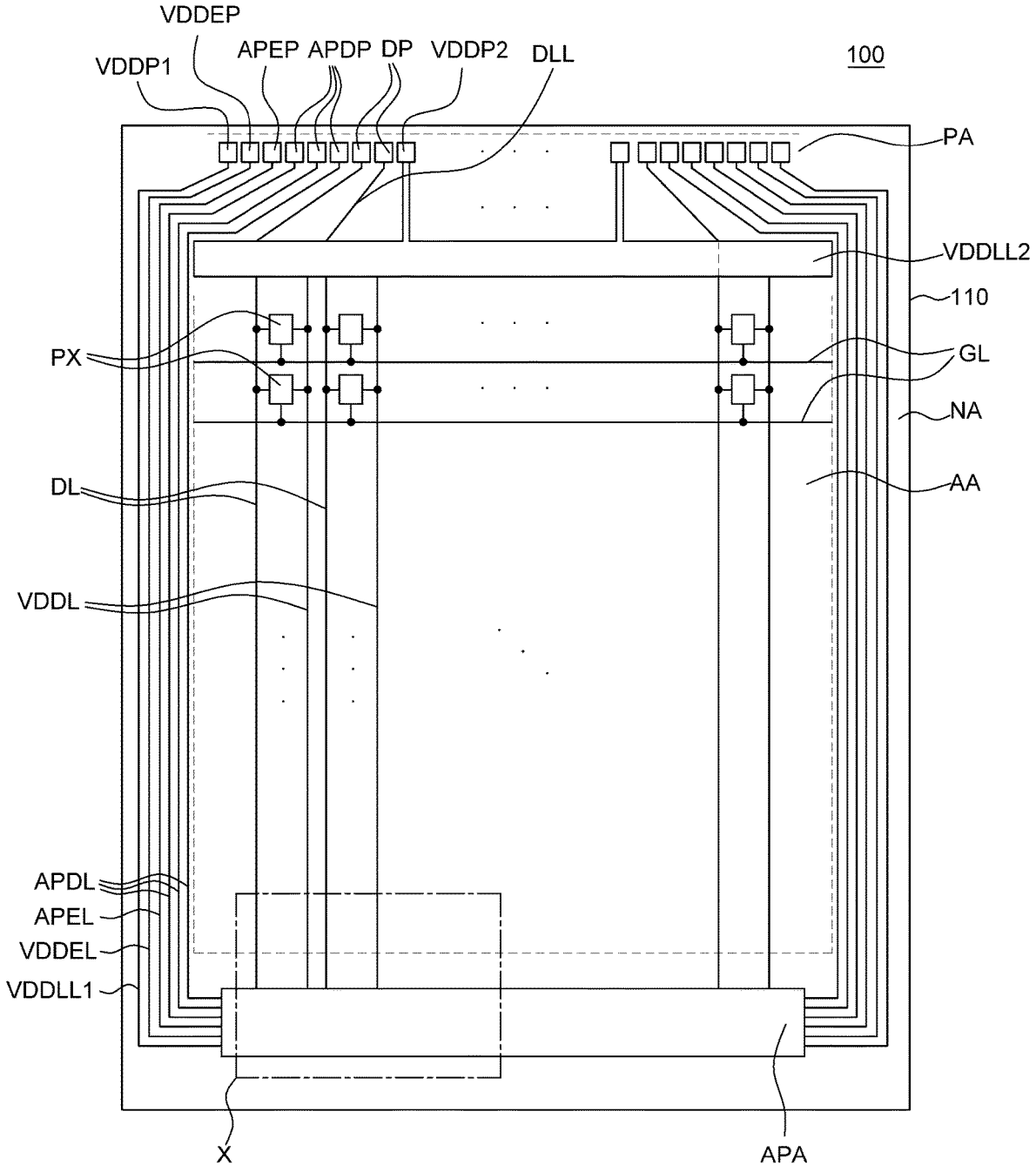
FIG. 1 is a plan view of an organic light-emitting display device according to an embodiment of the present disclosure.

The characteristics and features of the present disclosure and methods to achieve them will become apparent from the descriptions of exemplary embodiments hereinbelow with reference to the accompanying drawings. However, the present disclosure is not limited to exemplary embodiments disclosed herein but can be implemented in various different ways. The exemplary embodiments are provided for making the disclosure of the present disclosure thorough and for fully conveying the scope of the inventive features to those skilled in the art. It is to be noted that the scope of the present disclosure can be defined by the claims.

The figures, dimensions, ratios, angles, the numbers of elements given in the drawings are merely illustrative and are not limiting. Further, in describing the present disclosure, descriptions on well-known technologies can have been omitted in order not to unnecessarily obscure the gist of the inventive features. It is to be noticed that the terms "comprising," "having," "including" and so on, used in the description and claims, should not be interpreted as being restricted to the means listed thereafter unless specifically stated otherwise. Where an indefinite or definite article is used when referring to a singular noun, e.g. "a," "an," and "the," this includes a plural of that noun unless specifically stated otherwise.

For elements having specific values, they should be interpreted as including error margins even without explicit statements.

In describing positional relationships, such as "an element A on an element B," "an element A above an element B," "an element A below an element B," and "an element A next to an element B," another element C can be disposed between the elements A and B unless the term "directly" or "immediately" is explicitly used.

As used herein, the phrase "an element A on an element B" means that the element A can be disposed directly on the element B and/or the element A can be disposed indirectly on the element B via another element C.

The terms first, second and the like in the description and in the claims are used for distinguishing between similar elements and not necessarily for describing a sequential or chronological order. These terms are used to merely distinguish one element from another. Accordingly, as used herein, a first element can be a second element within the technical idea of the present disclosure.

Like reference numerals can denote like elements throughout the descriptions.

The drawings are not to scale and the relative dimensions of various elements in the drawings are depicted schematically and not necessarily to scale.

Features of various exemplary embodiments of the present disclosure can be combined partially or totally. As will be clearly appreciated by those skilled in the art, various technical interactions and operations are possible. Various exemplary embodiments can be practiced individually or in combination.

Hereinafter, exemplary embodiments of the present disclosure will be described in detail with reference to the accompanying drawings.

FIG. 1 is a plan view of an organic light-emitting display device according to an embodiment of the present disclosure. All the components of the organic light-emitting display devices according to all embodiments of the present disclosure are operatively coupled and configured.

For convenience of illustration, FIG. 1 shows only some of a variety of elements of an organic light-emitting diode (OLED) display device 100, e.g., a substrate 110, a plurality of pixels PX, a plurality of pads, supply voltage lines VDDLL1 and VDDLL2, power supply lines VDDL, a plurality of test data link lines APDL, a test enable signal line APEL, and a supply voltage enable signal line VDDEL. Those skilled in the art can understand that other components may be present or needed for a fully operational organic light-emitting display device.

The substrate 110 is for supporting and protecting various elements of the organic light-emitting display device. The substrate 110 can be made of glass or a plastic material having flexibility. When the substrate 110 is made of a plastic material, it can be made of, for example, polyimide (PI). It is, however, to be understood that the present disclosure is not limited thereto, as metal foil or other materials can also be used for the substrate as desired.

On the substrate 110, an active area AA and a non-active area NA surrounding or at least having some portion adjacent to the active area AA can be defined.

The active area AA is an area of the organic light-emitting display device 100 where an image is displayed. In the active area AA, display elements and various driving elements for driving the display elements can be disposed. For example, the display elements can be organic light-emitting elements each including an anode, an organic emissive layer, and a cathode. It is, however, to be understood that the present disclosure is not limited thereto. The display elements can be liquid-crystal display elements, inorganic light-emitting elements, micro-LEDs (micro-light emitting diodes), etc. In addition, various driving elements such as thin-film transistors, capacitors, lines, etc. for driving the display elements can be disposed in the active area AA. In the following description, organic light-emitting elements will be described as an example of the display elements.

The pixels PX are defined in the active area AA. Each of the pixels PX is a minimum unit for displaying an image and can be operated based on one or more operation signals, such as a data signal and a gate signal respectively provided through a data line DL and a gate line GL. The pixels PX can include some sub-pixels, such as a red sub-pixel, a green sub-pixel and a blue sub-pixel. In addition, the pixels PX can further include a white sub-pixel. Sometimes, the concept of pixels and sub-pixels can be interchangeably used or described hereafter. The particular number and arrangement of sub-pixels and/or pixels can be defined in numerous ways.

The non-active area NA is an area where no image is displayed, and a variety of lines, circuits and the like for driving the display elements in the active area AA are disposed therein. In addition, in the non-active area NA, lines (wires) and circuits for providing signals for driving the display elements can be disposed. The non-active area NA can surround the active area AA, as shown in FIG. 1. It is, however, to be understood that the present disclosure is not limited thereto. The non-active area NA can be defined as an area extended from or adjacent to the active area AA.

The non-active area NA can include a pad area PA in which a plurality of pads (or connection terminals) are formed. The pad area PA where a plurality of pads are disposed can be located on one side of the active area AA. In the pad area PA, a plurality of pads and an external module, e.g., a chip-on-film (COF), are bonded.

A driver (or other type of circuit) can be bonded to the plurality of pads in the pad area PA of the organic light-emitting display device 100. The driver can include a base film made of an insulating material, a conductive layer, and a driving IC (integrated circuit) disposed on the base film. The driver can supply (or transfer) the supply voltage, the data voltage, etc. to the plurality of pixels PX in the active area AA via the pads.

Referring to FIG. 1, the plurality of pads can include a plurality of data pads DP, a first supply voltage pad VDDP1, a second supply voltage pad VDDP2, a plurality of test data pads APDP, a test enable pad APEP, and a supply voltage enable pad VDDEP.

The data pads DP are for applying data voltages to the pixels PX arranged in the active area AA. The data pads DP can receive data voltages from the driver bonded to the data pads DP and can transfer such voltages to the data lines DL arranged in the active area AA via data link lines DLL disposed between the active area AA and the pad area PA.

The second supply voltage pad VDDP2 is for applying a high-level voltage to the second supply voltage line VDDLL2 disposed in the non-active area NA. The second supply voltage pad VDDP2 transfers the high-level voltage from the driver bonded to the second supply voltage pad VDDP2 to the second supply voltage line VDDLL2. Although only one second supply voltage pad VDDP2 is shown in FIG. 1, more than one second supply voltage pad VDDP2 can be employed.

The second supply voltage line VDDLL2 is for applying a high-level voltage to the pixels PX arranged in the active area AA. The second supply voltage line VDDLL2 is disposed between the active area AA and the pad area PA and is connected to the power supply lines VDDL arranged in the active area AA. Accordingly, the second supply voltage line VDDLL2 can transfer the high-level voltage applied from the second supply voltage pad VDDP2 to the pixels PX via the power supply lines VDDL.

The test data pads APDP and the test enable pad APEP are used for a lighting test. Specifically, the test enable pad APEP is for transferring a test enable signal to turn on/off the test transistors APTR disposed in a lighting test array APA when a lighting test is carried out. The test data pads APDP are for transferring the test data voltage to the lighting test array APA during the lighting test. Although only one test enable pad APEL is depicted in FIG. 1, more than one test enable pad APEL can be employed.

The test data link lines APDL transfer test data voltages from the test data pads APDP to the lighting test array APA. In addition, the test enable signal line APEL transfers the test enable signal from the test enable pad APEP to the lighting test array APA. Accordingly, the test data link lines APDL and the test enable signal can surround the active area AA. Although only one test enable signal line APEL is depicted in FIG. 1, more than one test enable signal line APEL can be employed.

The test data pads APDP, the test enable pad APEP, the test data link lines APDL and the test enable signal line APEL will be described in more detail later with reference to FIG. 2.

The first supply voltage pad VDDP1 and the supply voltage enable pad VDDEP are for applying a high-level voltage to the pixels PX arranged in the pixel area. Specifically, the supply voltage enable pad VDDEP is for transferring a signal to turn on/off the power supply transistors VDDTR disposed in the lighting test array APA when the organic light-emitting display device 100 is driven. The first supply voltage pad VDDP1 is for transferring a high-level voltage to the power supply transistors VDDTR when the organic light-emitting display device 100 is driven. A high-level voltage can be applied to the first supply voltage pad VDDP1 like the second supply voltage pad VDDP2. Specifically, the high-level voltage having the same level can be applied. Although only one first supply voltage line VDDP1 and one supply voltage enable pad VDDEP are depicted in FIG. 1, more than one first supply voltage line VDDP1 and more than one supply voltage enable pad VDDEP can be employed.

The first supply voltage line VDDLL1 transfers the high-level voltage from the first supply voltage pad VDDP1 to the lighting test array APA when the organic light-emitting display device 100 is driven. In addition, the supply voltage enable signal line VDDEL transfers a supply voltage enable signal to the lighting test array APA when the organic light-emitting display device 100 is driven. Thus, the first supply voltage line VDDLL1 and the supply voltage enable signal line VDDEL can surround the active area AA. Although only one first supply voltage line VDDLL1 and one supply voltage enable signal line VDDEL are depicted in FIG. 1, more than one first supply voltage line VDDLL1 and more than one supply voltage enable signal line VDDEL can be employed.

The first supply voltage pad VDDP1, the supply voltage enable pad VDDEP, the first supply voltage line VDDLL1 and the supply voltage enable signal line VDDEL will be described in more detail later with reference to FIG. 2.

The lighting test array APA can be disposed on the side of the active area AA opposite to the pad area PA. The lighting test array APA can include a plurality of test transistors APTR and a plurality of power supply transistors VDDTR. The lighting test array APA can be used to perform a lighting test on the pixels PX by using the test transistors APTR when the lighting test is carried out, and can supply a high-level voltage to the pixels PX when the organic light-emitting display device 100 is driven.

Hereinafter, the lighting test and high-level voltage supply by the lighting test array APA will be described in detail with reference to FIG. 2.

Figure 2:
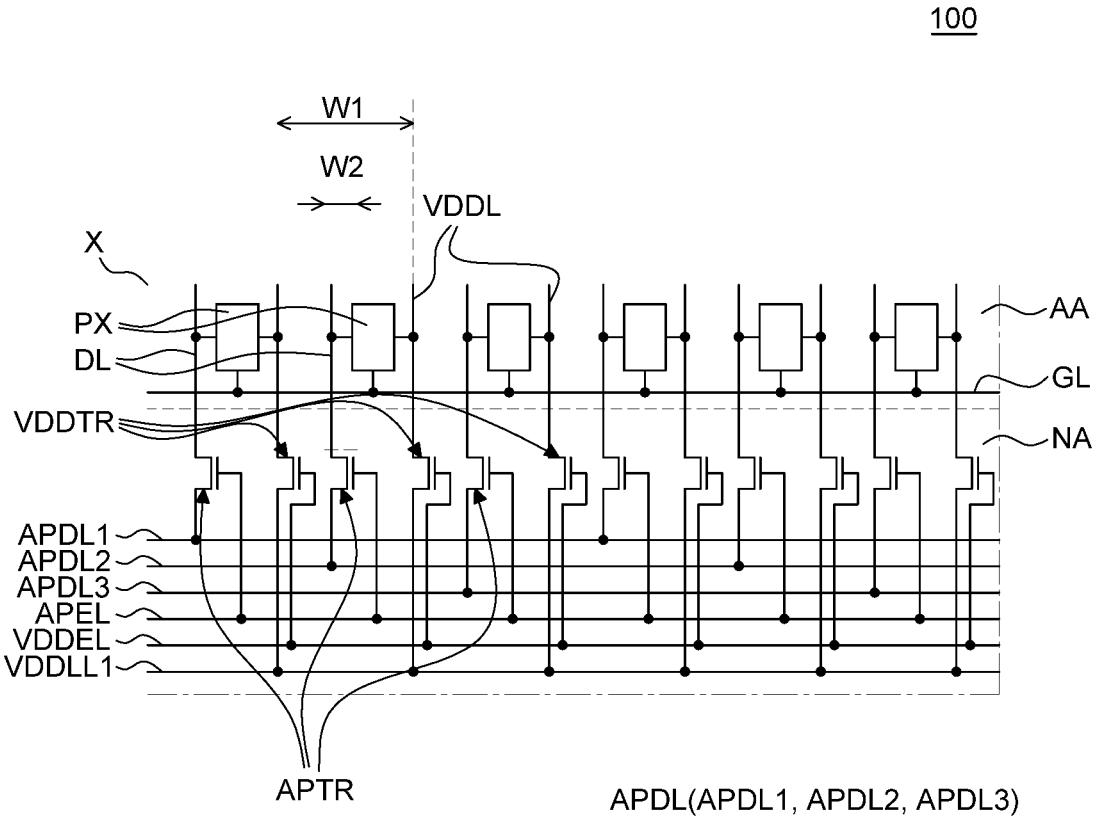
FIG. 2 is an enlarged view of area X of FIG. 1.

FIG. 2 is an enlarged view of area X of FIG. 1. For convenience of illustration, FIG. 2 shows only some of a variety of elements of an organic light-emitting display device 100, e.g., a plurality of pixels PX, a plurality of test transistors APTR, a plurality of power supply transistors VDDTR, a plurality of test data link lines APDL, a first supply voltage line VDDLL1, a test enable signal line APEL, and a supply voltage enable signal line VDDEL.

Referring to FIG. 2, the pixels PX are arranged in the active area AA. The pixels PX can include a red pixel, a green pixel and a blue pixel. Although it is assumed in FIG. 2 that the pixels PX include three kinds of sub-pixels including a red sub-pixel, a green sub-pixel and a blue sub-pixel, the present disclosure is not limited thereto and other variations are possible.

The test transistors APTR are arranged in the non-active area NA. The test transistors APTR are for applying the test data voltage to the pixels PX when a lighting test is carried out on the organic light-emitting display device 100. The test transistors APTR can be connected to a plurality of test data link lines APDL and a test enable signal line APEL. Specifically, the gate electrodes of the test transistors APTR can be connected to the test enable signal line APEL, one of the source electrodes and the drain electrodes thereof can be connected to the test data link lines APDL, and the other one of them can be connected to the data lines DL.

Referring to FIG. 2, the test data link lines APDL can include a first test data link line APDL1, a second test data line APDL2 and a third test data link line APDL3. As described above, since the pixels PX include the three kinds of sub-pixels of the red sub-pixel, the green sub-pixel and the blue sub-pixel, the test data link line APDL can also include three kinds of test data link lines APDL for the red sub-pixel, the green sub-pixel and the blue sub-pixel, respectively. For example, the first test data link line APDL1 can be the test data link line APDL for the red sub-pixel, the second test data link line APDL2 can be the test data link line APDL for the green sub-pixel, and the third test data link line APDL3 can be test data link line APDL for the blue sub-pixel. Accordingly, the test transistor APTR connected to the first test data link line APDL1 can be connected to the data line DL connected to the red sub-pixel. The test transistor APTR connected to the second test data link line APDL2 can be connected to the data line DL connected to the green sub-pixel. The test transistor APTR connected to the third test data link line APDL3 can be connected to the data line DL connected to the blue sub-pixel. If the pixels PX further include additional or different kinds of sub-pixels, a test data link line for the different or additional sub-pixels can be added.

By using above-described test data pads APDP, the test enable pad APEP, the test data link lines APDL, the test enable signal line APEL and the test transistors APTR, the lighting test can be carried out.

Referring to FIGS. 1 and 2, a test enable signal can be applied to the test enable pad APEP to turn on the test transistors APTR during the lighting test. When the test enable signal is applied to the test data pads APDP, the test enable signal is transmitted to the test transistors APTR via the test enable signal line APEL, such that the test transistors APTR can be turned on. The test enable signal line APEL can be connected to all of the test transistors APTR. When the test enable signal is applied via the test enable signal line APEL, all of the test transistors APTR can be turned on. It is, however, to be understood that the present disclosure is not limited thereto and other variations are possible.

Subsequently, the test data voltage can be applied via the test data pads APDP. For example, when the lighting test is carried on the red sub-pixel, the test data voltage can be applied to the test data pad APDP connected to the first test data link line APDL1 with the test enable signal applied to the test enable pad APEP. Since the test data voltage for the red pixel is applied via the first test data link line APDL1, the test transistor APTR and the data line DL, the lighting test can be carried on the red pixel. The lighting tests on the green sub-pixel and the blue sub-pixel can be carried out in the similarly manner.

The power supply transistors VDDTR are arranged in the non-active area NA. The power supply transistors VDDTR are for applying a high-level voltage to the pixels PX when the organic light-emitting display device 100 is driven. The power supply transistors VDDTR can be connected to the supply voltage enable signal line VDDEL and the first supply voltage line VDDLL1. Specifically, the gate electrode of each of the power supply transistor VDDTR can be connected to the supply voltage enable signal line VDDEL, one of the source electrode and the drain electrode thereof can be connected to the first supply voltage line VDDLL1, and the other of them can be connected to the respective power supply line VDDL.

By using the above-described first supply voltage pad VDDP1, the supply voltage enable pad VDDEP, the first supply voltage line VDDLL1, the supply voltage enable signal line VDDEL and the power supply transistors VDDTR, a high-level voltage can be supplied to the pixels PX.

Referring to FIGS. 1 and 2, a driver can be disposed in a pad area PA of the organic light-emitting display device 100. When the organic light-emitting display device 100 is driven, a supply voltage enable signal can be applied to the supply voltage enable pad VDDEP in order to turn on the power supply transistor VDDTR. When the supply voltage enable signal is applied to the supply voltage enable pad VDDEP, the supply voltage enable signal is transmitted to the power supply transistors VDDTR via the supply voltage enable signal line VDDEL, such that the power supply transistors VDDTR can be turned on. At this time, the supply voltage enable signal line VDDEL can be connected to all of the power supply transistors VDDTR. When the supply voltage enable signal is applied through the supply voltage enable signal line VDDEL, all of the power supply transistors VDDTR can be turned on. It is, however, to be understood that the present disclosure is not limited thereto.

Subsequently, a high-level voltage can be applied via the first supply voltage pad VDDP1. For example, while the supply voltage enable signal is applied to the supply voltage enable pad VDDEP, when a high-level voltage of the same level as the high-level voltage applied to the second supply voltage pad VDDP2 is applied to the first supply voltage pad VDDP1, the high-level voltage can be supplied to the pixels PX via the first supply voltage line VDDLL1 and the power supply transistors VDDTR. At this time, the first supply voltage line VDDLL1 can be connected to all of the power supply transistors VDDTR. It is, however, to be understood that the present disclosure is not limited thereto.

Referring to FIG. 2, the power supply transistors VDDTR and the test transistors APTR are arranged alternately. Specifically, the power supply transistors VDDTR and the test transistors APTR can be arranged alternately such that the ratio of the number of the power supply transistors VDDTR to the number of the test transistors APTR is 1:1. That is to say, as shown in FIG. 2, the power supply transistors VDDTR and the test transistors APTR can be alternately arranged one by one.

The width W2 of the area occupied by the test transistors APTR can be less than the pitch of the pixels PX. For example, the width W2 of the area occupied by each of the test transistors APTR can be less than the spacing W1 between the power supply lines VDDL or the spacing between the data lines DL. Typically, since the test transistors APTR only used to apply the test data voltage during the lighting test, the area occupied by the test transistors APTR can be less than the area occupied by the pixels PX. In particular, as shown in FIG. 2, the width W2 of the area occupied by the test transistors APTR is less than half the spacing W2 between the power supply lines VDDL or half the spacing between the data lines DL, the power supply transistors VDDTR and the test transistors APTR can be alternately arranged one by one.

The test transistors APTR used only during the lighting test and should not be turned on when the organic light-emitting display device 100 is driven in its normal operation. For example, when the organic light-emitting display device 100 is driven, a data voltage for driving the organic light-emitting display device 100 is applied to the data line DL via the data pad. Therefore, the test data voltage should not be applied to the data line DL via the test transistor APTR during normal operation. For this reason, the driver bonded to the pad area PA can be electrically insulated from the test enable signal line APEL. Alternatively, the driver can be electrically connected to the test enable signal line APEL, and a signal for turning off the test transistor APTR can be applied via the test enable signal line APEL as necessary.

Typically, a high-level voltage is applied to each of pixels PX via power supply lines extended from a supply voltage line arranged in a non-active area to an active area AA of a display device. Although the power supply lines are made of a metal material, the space occupied by the power supply lines decreases as the display device has a higher resolution, and the length of the power supply lines increases as the size of the display device increases. As a result, the resistance on the power supply lines is increased, such that a voltage drop can occur in the high-level voltage applied through the power supply lines. Due to such a voltage drop, the luminance of the conventional display device becomes different from location to location.

In view of the above, in the organic light-emitting display device 100 according to an embodiment of the present disclosure, the power supply transistors VDDTR are disposed on the side of the active area AA opposite to the pad area PA, a high-level voltage can be applied to the active area AA from the two sides. Specifically, a high-level voltage can be applied not only from the side of the active area AA via the first supply voltage line VDDLL1 disposed between the active area AA and the pad area PA, but also from the opposite side of the active area AA using the power supply transistors VDDTR disposed on the opposite side of the active area AA. In this manner, the conventional voltage drop in the high-level voltage that can possibly occur in the power supply lines VDDL can be mitigated, and the non-uniform luminance due to the conventional voltage drop can also be avoided.

Further, in the organic light-emitting display device 100 according to the embodiment of the present disclosure, the power supply transistors VDDTR are disposed in the substrate area that is no longer used once the lighting test is completed, to apply the high-level voltage. Accordingly, the substrate space can be utilized more efficiently. The test transistors APTR disposed on the opposite side of (or adjacent to) the active area AA are used only during the lighting test in the manufacturing process and are not used when the organic light-emitting display device 100 is driven in normal operation. Thus, the area where the test transistors APTR are disposed becomes useless once the lighting test is completed, such that it can increase the size of the non-active area NA unnecessarily.

In view of the above, in the organic light-emitting display device according to the embodiment of the present disclosure, the power supply transistors VDDTR are each disposed between two adjacent test transistors APTR, allowing the substrate area to be used even after the lighting test is completed. As a result, the substrate space can be utilized more efficiently. The circuit diagram of FIG. 2 shows the power supply transistors VDDTR and the test transistors APTR being aligned in an alternating manner along a single row direction, but different physical arrangements can be possible. For example, the power supply transistors VDDTR and the test transistors APTR can be staggered from each other or aligned in a different manner, such as alignment in two rows in the non-active area NA.

The power supply transistors VDDTR used in the organic light-emitting display device 100 according to the embodiment of the present disclosure can be formed together with the variety of transistors disposed in the active area AA and/or the test transistors APTR via the same process during manufacturing. Therefore, it requires neither an additional mask process for forming the power supply transistors VDDTR nor any significant changes in the overall manufacturing process. Accordingly, in the organic light-emitting display device 100 according to the embodiment of the present disclosure, the power supply transistors VDDTR to mitigate a voltage drop in a high-level voltage can be formed without incurring additional costs.

Figure 3:
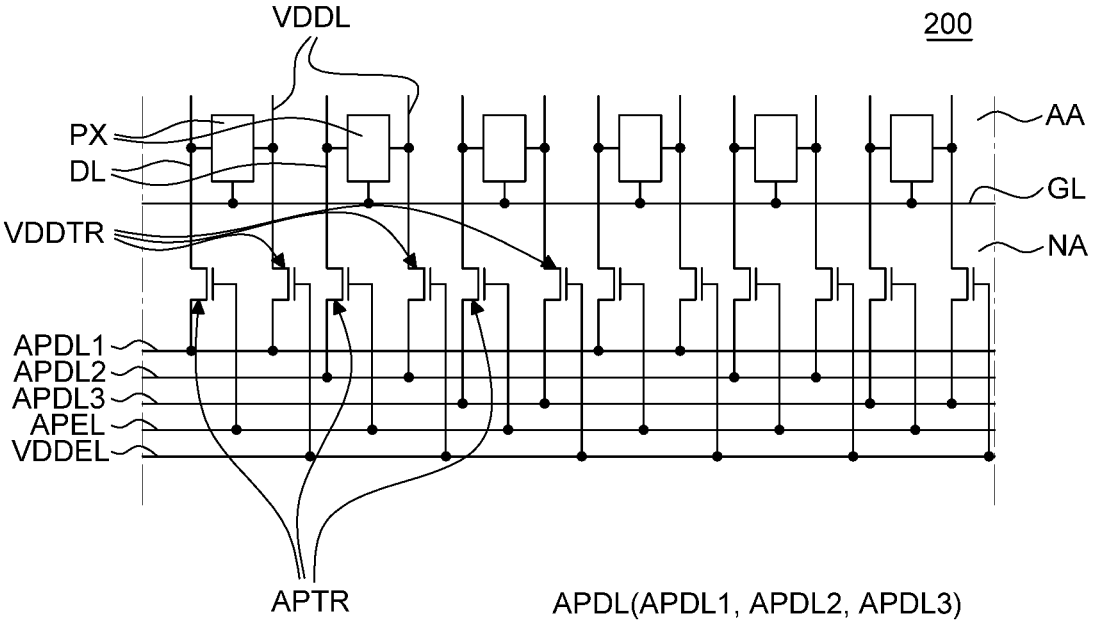
FIG. 3 is an enlarged view of an organic light-emitting display device according to another embodiment of the present disclosure.

FIG. 3 is an enlarged view of an organic light-emitting display device according to another embodiment of the present disclosure. An organic light-emitting display device 200 shown in FIG. 3 is substantially identical to the organic light-emitting display device 100 shown in FIGS. 1 and 2 except that the first supply voltage line is eliminated and test data link lines APDL work as the supply voltage line. Therefore, the redundant description will be omitted or will be brief.

In the organic light-emitting display device 200 according to this embodiment of the present disclosure, the test data link lines APDL can also apply a high-level voltage, and accordingly the first supply voltage line VDDLL1 can be eliminated.

The organic light-emitting display device 200 shown in FIG. 3 can be subjected to the lighting test in the same manner as the organic light-emitting display device 100 shown in FIGS. 1 and 2.

Specifically, when the test enable signal is applied to the test data pads APDP, the test enable signal is transmitted to the test transistors APTR via the test enable signal line APEL, such that the test transistors APTR can be turned on.

Subsequently, the test data voltage can be applied via the test data pads APDP. For example, when the lighting test is carried on the red sub-pixel(s), the test data voltage can be applied to the test data pad APDP connected to the first test data link line APDL1 with the test enable signal applied to the test enable pad APEP. Since the test data voltage for the red sub-pixel(s) is applied via the first test data link line APDL1, the test transistor APTR and the data line DL, the lighting test can be carried on the red sub-pixel(s). The lighting tests on the green sub-pixel and the blue sub-pixel can be carried out in the similarly manner.

However, the process of applying the high-level voltage through the power supply transistors VDDTR when the organic light-emitting display device 200 is driven is different from that of the organic light-emitting display device 100 shown in FIGS. 1 and 2.

Specifically, the power supply transistors VDDTR can be connected to the supply voltage enable signal line VDDEL and the test data link lines APDL. Specifically, the gate electrode of each of the power supply transistor VDDTR can be connected to the supply voltage enable signal line VDDEL, one of the source electrode and the drain electrode thereof can be connected to the test data link lines APDL, and the other of them can be connected to the respective power supply line VDDL.

A driver can be disposed in the pad area PA of the organic light-emitting display device 200. The driver can apply a voltage to turn on the power supply transistors VDDTR via the supply voltage enable signal line VDDEL. Specifically, when the organic light-emitting display device 200 is driven, a supply voltage enable signal can be applied to the supply voltage enable pad VDDEP from the driver in order to turn on the power supply transistors VDDTR. When the supply voltage enable signal is applied to the supply voltage enable pad VDDEP, the supply voltage enable signal is transmitted to the power supply transistors VDDTR via the supply voltage enable signal line VDDEL, such that the power supply transistors VDDTR can be turned on.

Subsequently, the driver can apply a high-level voltage to the test data link lines APDL. Specifically, a high-level voltage can be applied from the driver via the test data pads APDP. For example, while the power supply transistors VDDTR are turned on, when a high-level voltage having the same level as the high-level voltage applied to the second supply voltage pad VDDP2 is applied to the test data pads APDP, a high-level voltage can be applied to the pixels PX through the test data link lines APDL and the power supply transistors VDDTR. At this time, since the test transistors APTR are turned off, there is no problem in driving the organic light-emitting display device 200 even if the high-level voltage is applied to the test data link lines APDL.

In the organic light-emitting display device 200 according to another embodiment of the present disclosure, a high-level voltage is applied to the test data link lines APDL used for the lighting test when the organic light-emitting display device 200 is driven, such that the (substrate) space occupied by the lines in the organic light-emitting display device 200 can be reduced when compared to the related art. That is to say, instead of forming any additional line(s) for transferring the high-level voltage to the power supply transistor VDDTR, the test data link lines APDL for transferring the test data voltage during the lighting test can be used as a line for transferring the high-level voltage when the organic light-emitting display device 200 is driven. Accordingly, in the organic light-emitting display device 200 according to another embodiment of the present disclosure, it is possible to save the substrate space required to mitigate a voltage drop in the high-level voltage.

Figure 4:
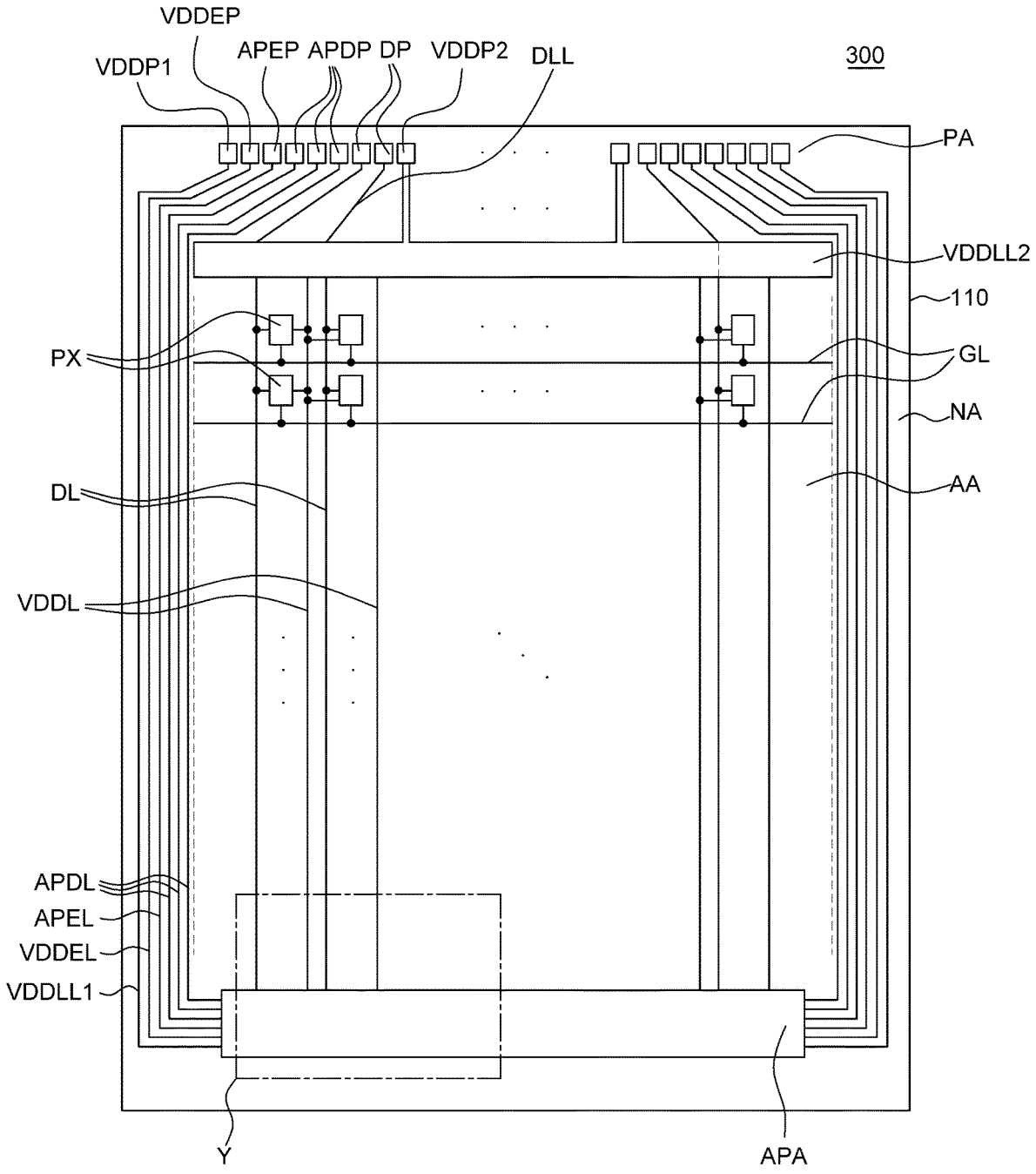
FIG. 4 is a plan view of an organic light-emitting display device according to yet another embodiment of the present disclosure.
Figure 5:
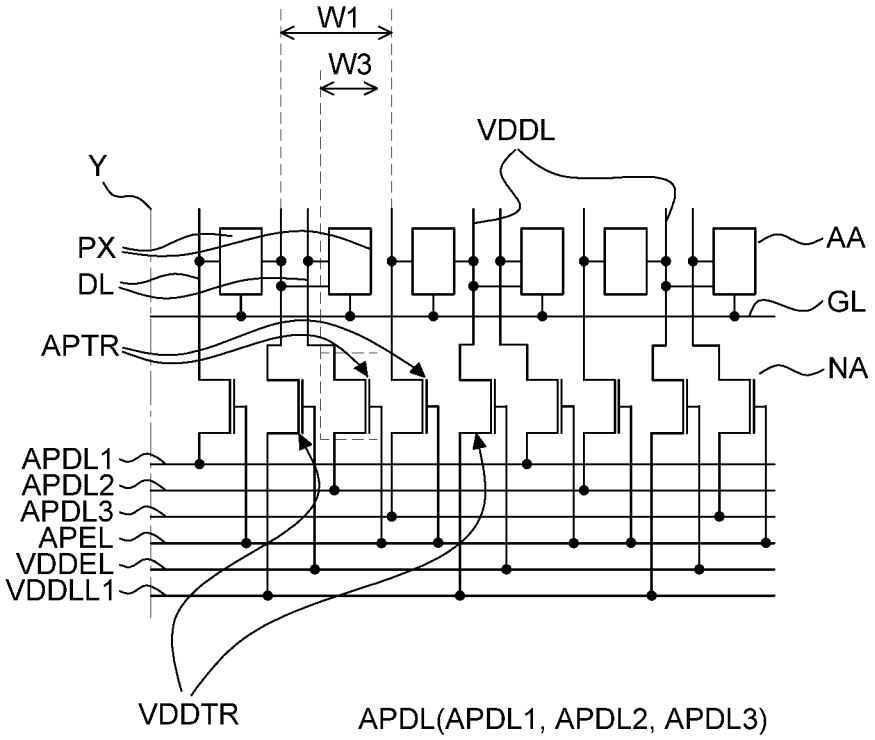
FIG. 5 is an enlarged view of area Y of FIG. 4.

FIG. 4 is a plan view of an organic light-emitting display device according to yet another embodiment of the present disclosure. FIG. 5 is an enlarged view of area Y of FIG. 4. The organic light-emitting display device 300 shown in FIGS. 4 and 5 is substantially identical to the display device 100 shown in FIGS. 1 and 2 except that several pixels PX share a power supply line VDDL. Therefore, the redundant description will be omitted or will be brief.

Referring to FIGS. 4 and 5, one pixel (or sub-pixel) among the plurality of pixels PX arranged in the active area AA is connected to a data line DL and to a power supply line VDDL disposed on its two sides, respectively, while another pixel (or sub-pixel) is connected to a data line DL disposed on its one side and to the power supply line VDDL between the two pixels (or sub-pixels) next to each other. That is to say, two pixels PX (or sub-pixels) next to each other can share one power supply line VDDL.

Referring to FIG. 5, as the pixels PX next to each other share the power supply line VDDL, power supply transistors VDDTR and test transistors APTR are arranged alternately. Here, the power supply transistors VDDTR and the test transistors APTR can be arranged alternately such that the ratio of the number of the power supply transistors VDDTR to the number of the test transistors APTR is 1:2. For example, as shown in FIG. 5, one power supply transistor VDDTR is disposed, and then two test transistors APTR are disposed, and so on. It is, however, to be understood that the present disclosure is not limited thereto. The specific ratio, arrangement, etc. can be adjusted or changed according to various characteristics of the final product, such as screen size, screen resolution, display environment, and the like.

The width W3 of the (substrate) area occupied by the test transistors APTR can be less than the pitch of the pixels PX. For example, the width W3 of the area occupied by each of the test transistors APTR can be less than the spacing W1 between the power supply lines VDDL or the spacing between the data lines DL. It is to be noted that, as shown in FIG. 5, the width W3 of the area occupied by each of the test transistors APTR can be less than half the spacing W1 between the power supply lines VDDL or half the spacing between the data lines DL. In this case, it can be difficult to form the power supply transistors VDDTR and the test transistors APTR such that the number of the power supply transistors VDDTR is equal to the number of the test transistors APTR. For this reason, in the organic light-emitting display device 300 according to yet another embodiment of the present disclosure, the power supply transistors VDDTR and the test transistors ARTR can be arranged alternately such that the ratio of the number of the power supply transistors VDDTR to the number of the test transistors APTR is 1:2.

In the organic light-emitting display device 300 according to yet another embodiment of the present disclosure, by adjusting the number of the power supply transistors VDDTR, it is possible to mitigate a voltage drop in the high-level voltage even when the test transistors APTR occupy a large area. Specifically, when the test transistors APTR occupy a large area, the pixels PX (or sub-pixels) share the power supply lines, and the number of the power supply transistors VDDTR is less than the number of the test transistors APTR, such that the space can be utilized more efficiently. In this manner, the voltage drop in the high-level voltage that can possibly occur in the power supply lines VDDL can be mitigated, and the non-uniform luminance due to the voltage drop can also be avoided. In addition, the space can be utilized more efficiently when compared to the related art.

The embodiments of the present disclosure can also be described as follows.

According to an aspect of the present disclosure, there is provided an organic light-emitting display device including a substrate having an active area in which a plurality of pixels are defined, and a non-active area surrounding the active area and having a pad area in which a plurality of pads are disposed on one side of the active area; a plurality of power supply lines disposed in the active area; a plurality of test transistors disposed in the non-active area on another side of the active area; and a plurality of power supply transistors connected to the plurality of power supply lines and disposed next to the respective test transistors.

The device can further include a plurality of test data link lines connected to the plurality of test transistors, a test enable signal line connected to the plurality of test transistors, and a supply voltage enable signal line connected to the plurality of power supply transistors.

The plurality of pads can include a plurality of test data pads connected to the plurality of test data link lines, at least one test enable pad connected to the test enable signal line, and at least one supply voltage enable pad connected to the supply voltage enable signal line.

The device can further include, a plurality of data lines disposed in the active area, wherein a gate electrode of each of the plurality of test transistors is connected to the test enable signal line, one of a source electrode and a drain electrode thereof is connected to the plurality of test data link lines, and the other one of the source electrode and the drain electrode thereof is connected to the plurality of data lines.

The device can further include a plurality of data link lines disposed between the active area and the pad area and connected to the data lines, wherein the pads further comprise a plurality of data pads connected to the data link lines.

The gate electrode of each of the power supply transistor can be connected to the supply voltage enable signal line, one of the source electrode and the drain electrode thereof can be connected to the test data link lines, and the other one of them can be connected to the respective power supply line.

The device can further include a driver bonded to the plurality of pads, wherein the driver is configured to apply a high-level voltage to the plurality of test data link lines and to apply a signal to turn on the plurality of power supply transistors via the supply voltage enable signal line.

The driver can be electrically insulated from the test enable signal line or can apply a signal to turn off the plurality of test transistors through the test enable signal line.

The device can further include a first supply voltage line connected to the plurality of power supply transistors, wherein the plurality of pads further comprise at least one first supply voltage pad connected to the first supply voltage line.

The gate electrode of each of the power supply transistor can be connected to the supply voltage enable signal line, one of the source electrode and the drain electrode thereof can be connected to the test data link lines, and the other one of them can be connected to the respective power supply line.

The test data link lines, the test enable signal line and the supply voltage enable signal line can surround the active area.

The width of the area occupied by the test transistors can be less than the spacing between the power supply lines.

The test transistors and the power supply transistors can be arranged alternately.

The number of the test transistors can be equal to or greater than the number of the power supply transistors.

Two pixels next to each other among the plurality of pixels can share one of the plurality of power supply lines.

The device can further include a second supply voltage line disposed between the pad area and the active area and connected to the plurality of power supply lines. The plurality of pads can include at least one second supply voltage pad connected to the second supply voltage line, and the second supply voltage pad can receive a voltage of a same level as the first supply voltage pad.

According to another aspect of the present disclosure, there is provided an organic light-emitting display device including a substrate having an active area in which a plurality of pixels are defined, and a non-active area surrounding the active area and having a pad area is disposed on one side of the active area; a plurality of power supply lines disposed in the active area; a plurality of test transistors disposed in the non-active area on two sides of the active area; and a plurality of power supply transistors each disposed between two of the test transistors. The power supply transistors apply a high-level voltage to the power supply lines to reduce a voltage drop in the power supply lines.

The device can further include a plurality of test data link lines connected to the plurality of test transistors, a test enable signal line connected to the test transistors, and a supply voltage enable signal line connected to the plurality of power supply transistors.

The test transistors and the power supply transistors can be arranged alternately.

Thus far, exemplary embodiments of the present disclosure have been described in detail with reference to the accompanying drawings. However, the present disclosure is not limited to the exemplary embodiments, and modifications and variations can be made thereto without departing from the technical idea of the present disclosure. Accordingly, the exemplary embodiments described herein are merely illustrative and are not intended to unnecessarily limit the scope of the present disclosure. The technical idea of the present disclosure is not limited by the exemplary embodiments. Therefore, it should be understood that the above-described embodiments are not limiting but illustrative in all aspects. The scope of protection sought by the present disclosure can be defined by the appended claims and all equivalents thereof are construed to be within the true scope of the present disclosure.

What is claimed is:

1. An organic light-emitting display device comprising:

a substrate comprising an active area in which a plurality of pixels are defined, and a non-active area surrounding the active area and having a pad area in which a plurality of pads are disposed on one side of the active area;

a plurality of power supply lines disposed in the active area:

a plurality of test transistors disposed in the non-active area on another side of the active area; and a plurality of power supply transistors connected to the plurality of power supply lines, and disposed next to the respective test transistors, wherein the plurality of test transistors and the plurality of power supply transistors are arranged alternately one by one along a single row direction, wherein the organic light-emitting display device further comprises:

a plurality of test data link lines connected to the plurality of test transistors, respectively;

a test enable signal line connected to the plurality of test transistors;

a supply voltage enable signal line connected to the plurality of power supply transistors; and a plurality of data lines disposed in the active area, wherein a gate electrode of each of the plurality of test transistors is connected to the test enable signal line, one of a source electrode and a drain electrode thereof is connected to the plurality of test data link lines, and the other one of the source electrode and the drain electrode thereof is connected to the plurality of data lines, and wherein a gate electrode of each of the plurality of power supply transistors is connected to the supply voltage enable signal line, one of a source electrode and a drain electrode thereof is connected to the plurality of test data link lines, and the other one of the source electrode and the drain electrode thereof is connected to the plurality of power supply lines.

2. The organic light-emitting display device of claim 1, wherein the plurality of pads comprise:

a plurality of test data pads connected to the plurality of test data link lines;

at least one test enable pad connected to the test enable signal line; and at least one supply voltage enable pad connected to the supply voltage enable signal line.

3. The organic light-emitting display device of claim 1, further comprising:

a plurality of data link lines disposed between the active area and the pad area and connected to the plurality of data lines, wherein the plurality of pads further comprise a plurality of data pads connected to the plurality of data link lines.

4. The organic light-emitting display device of claim 1, further comprising:

a driver bonded to the plurality of pads, wherein the driver is configured to apply a high-level voltage to the plurality of test data link lines and to apply a signal to turn on the plurality of power supply transistors through the supply voltage enable signal line.

5. The organic light-emitting display device of claim 4, wherein the driver is electrically insulated from the test enable signal line or applies a signal to turn off the plurality of test transistors through the test enable signal line.

6. The organic light-emitting display device of claim 1, wherein the plurality of test data link lines, the test enable signal line and the supply voltage enable signal line are arranged so as to surround the active area.

7. An organic light-emitting display device comprising:

a substrate comprising an active area having a plurality of pixels, and a non-active area adjacent to the active area and having a pad area next to one side of the active area;

a plurality of power supply lines in the active area;

a plurality of test transistors in the non-active area next to two sides of the active area; and a plurality of power supply transistors each of the plurality of power supply transistors being disposed between two adjacent test transistors among the plurality of test transistors in the non-active area on another side of the active area, wherein the plurality of power supply transistors apply a high-level voltage to the plurality of power supply lines to reduce a voltage drop in the plurality of power supply lines, and wherein the plurality of test transistors and the plurality of power supply transistors are arranged alternately one by one along a single row direction, wherein the organic light-emitting display device further comprises:

a plurality of test data link lines connected to the plurality of test transistors, respectively;

a test enable signal line connected to the plurality of test transistors;

a supply voltage enable signal line connected to the plurality of power supply transistors;

a first supply voltage line connected to the plurality of power supply transistors; and a plurality of data lines disposed in the active area, wherein a gate electrode of each of the plurality of test transistors is connected to the test enable signal line, one of a source electrode and a drain electrode thereof is connected to the plurality of test data link lines, and the other one of the source electrode and the drain electrode thereof is connected to the plurality of data lines, and wherein a gate electrode of each of the plurality of power supply transistors is connected to the supply voltage enable signal line, one of a source electrode and a drain electrode thereof is connected to the first supply voltage line, and the other one of the source electrode and the drain electrode thereof is connected to the plurality of power supply lines.

8. The organic light-emitting display device of claim 7, further comprising:

a plurality of pads disposed on the pad area, wherein the plurality of pads further comprise at least one first supply voltage pad connected to the first supply voltage line.

9. The organic light-emitting display device of claim 8, further comprising:

a second supply voltage line disposed between the pad area and the active area and connected to the plurality of power supply lines, wherein the plurality of pads comprise at least one second supply voltage pad connected to the second supply voltage line, and the second supply voltage pad receives a voltage of a same level as the first supply voltage pad.

10. The organic light-emitting display device of claim 7, wherein a width (W2) of an area occupied by each of the plurality of test transistors is less than a spacing (W1) between two adjacent power supply lines among the plurality of power supply lines.

11. The organic light-emitting display device of claim 7, wherein a number of the plurality of test transistors is equal to or greater than a number of the plurality of power supply transistors.

12. The organic light-emitting display device of claim 11, wherein two pixels next to each other among the plurality of pixels share one of the plurality of power supply lines.

* * * * *